US005209480A

United States Patent [19]

Katz

[11] Patent Number: 5,209,480

[45] Date of Patent: May 11, 1993

[54] PUZZLE WITH PLANER OVERLAPPING SLOTTED PIECES

[76] Inventor: Daniel S. Katz, 531 E. 20th St., New York, N.Y. 10010

[21] Appl. No.: 647,685

[22] Filed: Jan. 28, 1991

Related U.S. Application Data

[63] Continuation of Ser. No. 455,226, Dec. 22, 1989, abandoned, which is a continuation-in-part of Ser. No. 434,877, Nov. 13, 1989, abandoned.

[51] Int. Cl.[5] ..... A63F 9/10

[52] U.S. Cl. ..... 273/157 R; 446/122; 446/125

[58] Field of Search ..... 273/276, 153 R, 156, 273/157 R, 160; 434/96, 69; 446/105, 108, 109, 116, 122, 124, 125, 127

[56] References Cited

U.S. PATENT DOCUMENTS

| | | | |
|---|---|---|---|
| 1,569,427 | 1/1926 | Kurtz | 446/122 |
| 2,099,075 | 11/1937 | Paulson | 446/122 |
| 3,564,758 | 2/1971 | Willis | 446/109 |
| 3,895,456 | 7/1975 | Fabre | 446/122 X |
| 4,361,328 | 11/1992 | Stein | 273/156 |
| 4,666,163 | 5/1987 | Hirschfield | 273/157 R X |

FOREIGN PATENT DOCUMENTS

| | | | |
|---|---|---|---|
| 0637544 | 3/1962 | Canada | 273/137 |
| 0573378 | 11/1945 | United Kingdom | 446/122 |
| 2054393 | 2/1981 | United Kingdom | 446/122 |

*Primary Examiner*—William H. Grieb
*Assistant Examiner*—William M. Pierce
*Attorney, Agent, or Firm*—William E. Pelton

[57] ABSTRACT

Apparatus for displaying ingenuity and creativity consists of a plurality of modules that have first and second surfaces, that are planar, angled or curved, and that have slits in at least two sides of the perimeters of the modules. Portions of the modules constitute display surfaces adapted to carry segments of a pattern. The slits of each module may be interlinked with the slits of adjacent modules to form a composite assembly in two or three dimensions that displays a newly created pattern or a predetermined pattern or succession of predetermined patterns on one or both of the first and second surfaces of the composite assembly.

15 Claims, 19 Drawing Sheets

| | C1 | C2 | C3 | C4 | C5 |
|---|---|---|---|---|---|
| R1 | 11 | 12 | 13 | 14 | 15 |
| R2 | 21 | 22 | 23 | 24 | 25 |
| R3 | 31 | 32 | 33 | 34 | 35 |
| R4 | 41 | 42 | 43 | 44 | 45 |
| R5 | 51 | 52 | 53 | 54 | 55 |

FIG. 5

| | C1 | C2 | C3 | C4 | C5 |
|---|---|---|---|---|---|
| R1 | 11 | 12 | 13 | 14 | 15 |
| R2 | 21 | 22 | 23 | 24 | 25 |
| R3 | 31 | 32 | 33 | 34 | 35 |
| R4 | 41 | 42 | 43 | 44 | 45 |
| R5 | 51 | 52 | 53 | 54 | 55 |

FIG. 9

| | C1 | C2 | C3 | C4 | C5 |
|---|---|---|---|---|---|
| R1 | 11 | 12 | 13 | 14 | 15 |
| R2 | 21 | 22 | 23 | 24 | 25 |
| R3 | 31 | 32 | 33 | 34 | 35 |
| R4 | 41 | 42 | 43 | 44 | 45 |
| R5 | 51 | 52 | 53 | 54 | 55 |

FIG. 13

| | C1 | C2 | C3 |
|---|---|---|---|
| R1 | 11 | 12 | 13 |
| R2 | 21 | 22 | 23 |
| R3 | 31 | 32 | 33 |
| R4 | 41 | 42 | 43 |

FIG. 16

PUZZLE WITH PLANER OVERLAPPING SLOTTED PIECES

CROSS-REFERENCE TO RELATED APPLICATION

This is a continuation of application Ser. No. 07/455,226 filed Dec. 22, 1989, now abandoned, which is a continuation-in-part of application Ser. No. 07/434,877, now abandoned, filed Nov. 13, 1989.

BACKGROUND OF THE INVENTION

1. Field of the Invention

The present invention relates to puzzles and/or games in general and in particular to games and puzzles of the assembly type in which a plurality of graphic or indicia-bearing puzzle or game pieces are assembled or interconnected so as newly to create or restore a complete graphic pattern such as a predetermined picture or other display. More particularly, the present invention relates to an assembly puzzle and a method for creating a graphic display or restoring a predetermined graphic display in which a plurality of indicia-bearing puzzle pieces are separably interleaved together so that sections of the puzzle pieces overlap one another to cover certain non-indicia-bearing surface portions thereof or, at least in some embodiments, to cover indicia-bearing surface portions which are not part of the graphic display being created or restored and to leave selected surface portions exposed. The resulting composite or solved puzzle may thereby display one or more newly created graphic patterns or restored predetermined graphic patterns on either the front or reverse side of the assembled composite (or on the outside or inside if the assembly forms a three-dimensional structure), or on both sides.

2. Description of the Prior Art

Various assembly puzzles of the general type with which the present invention is concerned are known in the art. Examples of these are shown in U.S. Pat. No. 3,923,307 dated Dec. 2, 1975 in the name of V. J. Sukys; U.S. Pat. No. 4,666,163 dated May 19, 1987 in the name of U. Hirschfeld; and U.S. Pat. No. 4,419,081 dated Dec. 6, 1983 in the name of P. R. Steinmann.

U.S. Pat. No. 3,923,307 to Sukys is deemed illustrative of the state of the art in puzzles or games that are assembled to form geometric configurations. However, there is no way to interlink the sections in U.S. Pat. No. 3,923,307. Sukys neither illustrates nor suggests a puzzle consisting of a plurality of indicia-bearing and separably interleaveable puzzle pieces which, upon assembly of overlapping pieces into a composite, may display one or more different newly created graphic patterns or restored graphic patterns on either a first or second surface (e.g., the front or back surface) or on both such surfaces of the assembled composite. Nor does Sukys disclose or suggest such a puzzle the solution to which consists of creating or restoring one complete graphic pattern on the first surface of the composite while at the same time creating or restoring a different graphic pattern on the second surface of the assembled puzzle.

U.S. Pat. No. 4,666,163 to Hirschfeld is deemed illustrative of the state of the art in card games in which each card has one slit that is used to insert the card into the slit of one other card thereby forming a card pair. However, Hirschfeld fails to illustrate or suggest a puzzle or game of the type disclosed herein in which the solution is achieved by the method of interleaving more than two puzzle or game pieces by which they overlap one another in order newly to create or restore one or more different complete graphic patterns on either the first or second (e.g., front or back) surface of the assembled composite. Nor does Hirschfeld disclose or suggest such a puzzle the solution to which consists of the method of restoring one predetermined graphic pattern on the front surface of the assembled composite while at the same time restoring another predetermined and different graphic pattern on the back surface of the assembled puzzle. Moreover, Hirschfeld fails to disclose or suggest a puzzle in which one or more complete graphic patterns can be divided among an unlimited number of overlapping puzzle pieces. Hirschfeld also does not disclose or suggest a puzzle in which the composite assembled as a result of overlapping the puzzle pieces can be of any shape or size so long as it is a multiple of the puzzle piece. Finally Hirschfeld fails to disclose or suggest a puzzle of the type disclosed herein in which the method of interleaving puzzle pieces allows the distribution and restoration of three complete and different graphic patterns on the front surface of the assembled composite and three more on the back.

U.S. Pat. No. 4,419,081 to Steinmann is deemed illustrative of the state of the art in mathematical teaching aids that use cards or blocks to illustrate processes for solving algebraic equations by mating each block edge-to-edge via mating edge alignment tabs and notches. The Steinmann blocks however can only be mated in one configuration. Steinmann also fails to disclose or to suggest a puzzle or game of the type disclosed herein in which the solution is achieved by the method of interleaving the puzzle pieces so as newly to create a graphic pattern or restore one or more different predetermined graphic patterns on either the first or second (e.g., front or back) surface of the assembled composite. Nor does Steinmann disclose or suggest such a puzzle the solution to which is represented by an interleaved composite displaying one restored graphic pattern on the front surface while at the same time a restored but different graphic pattern is displayed on the back surface of the assembled puzzle.

Nor do the aforementioned patents disclose the extension of the invention disclosed and claimed in application Ser. No. 07/434,877 (hereinafter sometimes called the "co-pending application") to the third dimension.

OBJECTS AND SUMMARY OF THE INVENTION

An object of the invention is to remedy the problems of the prior art noted above. In particular, an object of the invention is to provide a game comprising a plurality of game pieces that can be assembled to form a shape in three dimensions.

The present invention builds upon and extends the invention disclosed in the co-pending application referred to above. That invention provides a method and apparatus by which one's ingenuity or creativity may be displayed. More particularly, that invention comprises a plurality of modular pieces, each such piece having first and second surfaces and consisting of a module that is planar and has inwardly directed slits in at least two sides of the perimeter of the module. The first and second surfaces can be, for example, front and back surfaces if the modules are assembled to form a flat structure or, in accordance with the present invention as more fully described below, inside and outside surfaces if the modules are assembled to form a three-dimensional structure such as a house. The multiple slits enable the practice of the method of the present invention by which the puzzle modules are interlinked so that, for example, while portions of a first module selectively overlap corresponding portions of a second module and, at the same time, selected portions of the first module are themselves overlapped by corresponding portions of the second module, both of said modules may be further overlapped by other modules. In this way, an assembled composite of a plurality of such modules may be provided such that selected sections of the modules remain exposed so as to display for example at least one newly-created graphic pattern or at least one predetermined graphic pattern on at least one of the first surface or second surface of the composite assembly.

Several embodiments of the invention claimed in the co-pending application are described below by way of example and are not intended to limit the scope of that or the present invention. For example, while the preferred embodiment is described in the context of a physical assembly type puzzle, the invention includes a method of combining and displaying selected surfaces bearing predetermined geometric or other graphic figures by displacing non-indicia-bearing surfaces or surfaces bearing undesired indicia with indicia-bearing surfaces thereof. In this way the ultimate composite displays a newly created pattern or a predetermined pattern defined by the exposed indicia-bearing surfaces. This method may be practiced in simulations created on a video screen by a computer program or the like without departing from the scope of the invention.

In a preferred embodiment each module is a parallelogram substantially square in shape and is provided with four slits one each in each of its perimeter edges. The four slits are inwardly directed substantially perpendicular to the perimeter edge of the module and preferably extend approximately one-half of the distance toward the center of the module from approximately the midpoint along the respective module edges. In other embodiments there may be two, three, four or more slits in the modules depending upon the desired level of complexity in the puzzle. Although the modules in this preferred embodiment are square, in other embodiments the modules may be polygonal or circular as desired.

The number of modules to a game or puzzle may vary with the level of complexity and the expertise of the intended puzzle user. It has been found that with as few as four puzzle modules it is possible to form numerous newly created graphic patterns on the first surface of the assembled composite and on the second surface. It has further been found that with as few as six puzzle modules it is possible sequentially to restore two predetermined graphic patterns on the front surface of the assembled composite and two predetermined graphic patterns on the back surface. It has also been found that as few as forty-two such puzzle modules may be used to enable the sequential restoration of three different complete graphic patterns on the front surface and three different complete graphic patterns on the back surface. In other embodiments it has been found that any number of puzzle modules greater than three will enable restoration of a predetermined graphic pattern on the front surface or on the back surface, as desired. All embodiments with more than three puzzle modules are also capable of being assembled in such a way as simultaneously to restore a first predetermined graphic pattern on the first surface and a second predetermined graphic pattern on the second surface.

It is within the scope of the present invention to employ modular pieces that are flat (planar) or that form a dihedral angle of, for example, 90°, 110° or 135° about a centerline, or that are cylindrically curved or curved in some other manner, or that form a corner where three surfaces intersect. The various three-dimensional shapes employed in accordance with the present invention enable the construction of three-dimensional assemblies resembling houses, etc.

The present invention also has utility as a game by which indicia-bearing modules are assembled to form whimsical patterns. For example, the final pattern may be achieved by the interaction of chance and the choices made by one or more players. Ordinary "Domino" markings may be applied to the modules with the rule being such that exposed segments of the module must be matched. Other indicia, such as those from the oriental hand game of "scissors, paper, stone," may be applied to the modules. By way of example, the presence of the game symbols "scissors, paper and stone" as indicia on the modules would control play of the game in accordance with the rule that when modules are interleaved they cannot violate the basic relationships ascribed to the scissors, the paper and the stone. In another game the modules may be blank and a player draws a picture on the assembled composite. The composite is disassembled and the game challenge is for the next player or players to assemble it and so on. In this way clever puzzle creation and puzzle solving will be rewarded. The time required to solve the puzzles can be the deciding factor in such a game.

As indicated above, the present invention builds upon and extends the invention disclosed in the co-pending application referred to above. In accordance with the present invention, a game is provided comprising: a plurality of game pieces; at least one display surface formed on predetermined ones of the game pieces; and means for assembling more than two of the game pieces together by interleaving the game pieces so as to cover some of the display surfaces and to dispose selected display surfaces thereby to form a composite of the game pieces whereby all of the selected display surfaces are exposed; wherein at least one of the game pieces is non-planar.

For example, the game pieces may include one or more that form a dihedral angle, one or more that form a corner defined by the intersection of three planar surfaces, and/or one or more that are cylindrically or otherwise curved. In addition, flat pieces as disclosed and claimed in the copending application and described herein may be employed.

BRIEF DESCRIPTION OF THE DRAWINGS

The invention is herein described by way of example only with reference to the accompanying drawings, wherein:

FIG. 5 is a schematic view in matrix format showing the rows and columns of the visible quadrants of assembled puzzle modules after the graphic pattern of FIG. 4 is restored on one surface of the composite puzzle;

FIG. 9 is a schematic view in matrix format showing the rows and columns of the visible quadrants of assembled puzzle modules after the graphic pattern of FIG. 8 is restored on one surface of the composite puzzle;

FIG. 13 is a schematic view in matrix format showing the rows and columns of the visible quadrants of assembled puzzle modules after the graphic pattern of FIG. 12 is restored on one surface of the composite puzzle;

FIG. 16 is a schematic view showing in matrix format of the rows and columns defined by the visible quadrants of a composite puzzle consisting of six modules after restoration of a simplified graphic pattern.

DESCRIPTION OF THE PREFERRED EMBODIMENTS

Figure 1A:
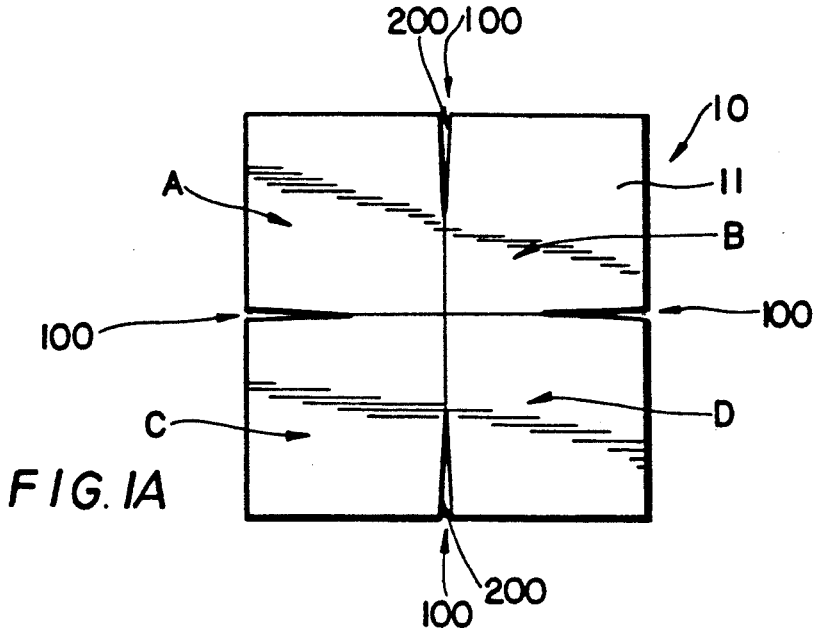
FIG. 1A illustrates a top view of one surface of one embodiment a single puzzle module for use in the present invention.

With reference first to FIG. 1A, there is shown a puzzle or game module 10 employed in the preferred embodiment of the present invention. This module 10 of FIG. 1A is a square configuration preferably having a surface area 11 on each side of the module of approximately four square inches. As described below, the surface area 11 of the square embodiment is divided into four equal area quadrants A, B, C and D. Each of these quadrants has four one inch long straight sides, two of which are on the outside of the module. Quadrants A–D of surface area 11 are adapted to carry indicia which represent units or segments of a graphic pattern. Typically, there are as many indicia-bearing quadrants as there are segments of the complete pattern and not all quadrants need be indicia-bearing. Indeed, as indicated below, not all modules need be indicia-bearing. The pattern may be predetermined, as in a jig-saw type puzzle, or may be created on the module surfaces as part of a game, as desired.

A slit 100 extends inwardly from the edge of the module along each common side of adjacent quadrants. In the preferred embodiment these slits intersect the module for approximately one-quarter of its width. The shape of the slit is exaggerated in FIG. 1 for purpose of illustration. It may comprise the open V-shape as shown, or may simply be an inwardly directed cut, as desired. The width of each slit 100 at the perimeter of the module is also exaggerated in FIG. 1, although the slits must be capable of permitting fast interleaved engagement with and/or disengagement from other modules during the playing of the puzzle by which the modules interlink and overlap with each other to restore the predetermined graphic pattern. The two sides 200 of the slit 100 of module 10 may be spaced apart by any appropriate amount in order to facilitate such interlinking with or disengagement from adjacent modules.

In the preferred embodiment the module 10 is made of a thin, flexible plastic material so that the puzzle will be easy to assemble yet durable. The invention is not to be limited however to the nature, configuration or material of the individual puzzle modules. The modules should be able to withstand countless interleaving procedures, be lightweight and durable, and retain the displayed graphic indicia.

For ease of illustration only, all of the puzzle modules illustrated individually in FIGS. 6, 7, 10, 11, 14 and 15 in the preferred embodiment are identical to the module 10 depicted in FIG. 1A. This particular module is the module designated module 1 in FIGS. 6, 7, 10, 11, 14 and 15. In addition, module 10 is the module in the extreme upper left hand corner of the puzzle in the complete graphic arrangement, the Beach Scene, shown in FIGS. 4 and 5 and in the Beach Scene solution keys of FIGS. 6 and 7.

Figure 1B:
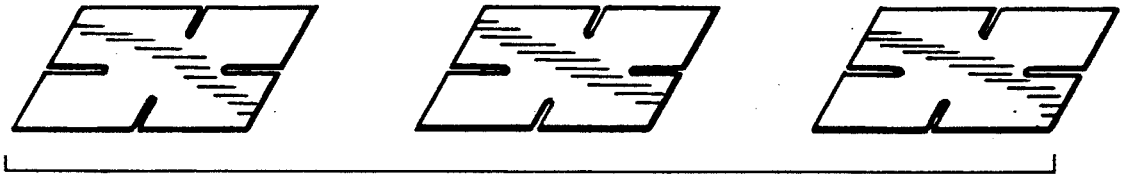
FIG. 1B is an elevated view of a group of three puzzle modules of the present invention having another geometric configuration.
Figure 1C:
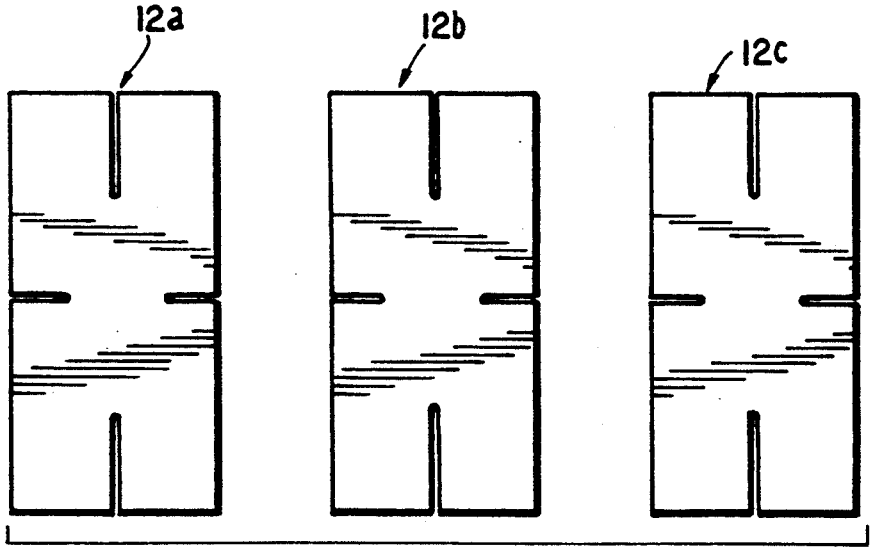
FIG. 1C is an elevated view of a group of three puzzle modules of the present invention having still another geometric configuration.

The puzzle or game modules, however, may take other geometric configurations. FIG. 1C depicts a group of three substantially rectangular modules 12*a*–12*c*. As with the square version of the module, the slits in the rectangular modules extend inwardly from about the midpoint of each edge along mutually orthogonal centerlines. It has been found that where a four sided module is used it is preferable that opposite sides of the module be substantially parallel. Thus, the configuration show in FIG. 1B is also perfectly acceptable for use in the present invention. This configuration has been found to be appropriate irrespective of whether the module is substantially square or rectangular.

Figure 1D:
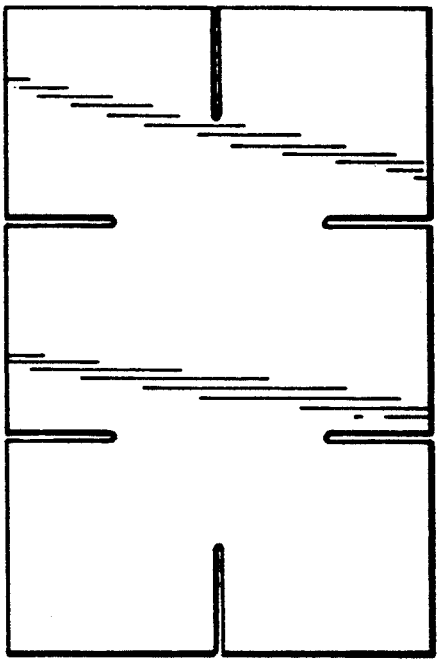
FIG. 1D is an elevated view of another embodiment of a single puzzle module for use in the present invention.
Figure 1E:
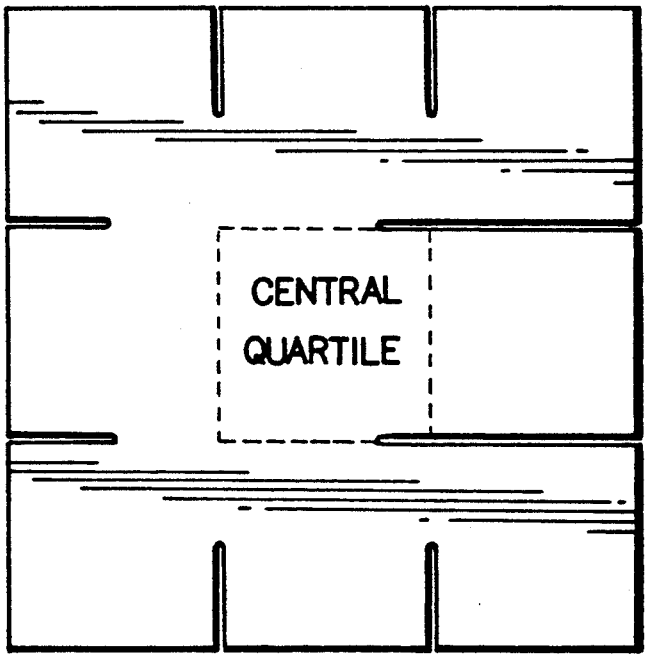
FIG. 1E is an elevated view of yet another embodiment of a single puzzle module for use in the present invention.

The geometric configurations of FIGS. 1A–1B, at least where the modules are substantially square, give rise to relatively complex puzzles or games because any side of a module can properly intersect any other side of another module. Less complex puzzles or games can be achieved where the sides of the modules are not all about the same length, as for example where the modules are rectangular as shown in FIG. 1C. Under these circumstances, each side of the module has only two intersection possibilities. However, where the module is provided with two slits on the extended sides, as shown in FIG. 1D, more complexity can be introduced. As shown in FIG. 1E, even more complexity can be introduced into the puzzle where all sides of the module are provided with more than one slit. It should also be noted that in the configuration of FIG. 1E a relative "dead space," i.e. a space that cannot be covered by another similar module, will result at the center of the module. This may be remedied by extending one or more of the slits as shown in order to permit an adjoining module to be moved inwardly so as to overlap the center section. Alternatively, such a "dead space" may be incorporated into the predetermined graphic pattern.

It has been found that the puzzle of the present invention does not require that every puzzle module have slits. It is evident that a puzzle module without slits can be effectively linked to an adjoining module having slits so that portions or all of the unslitted module may be covered or left exposed as desired. In addition, the invention does not require that all modules have equal surface areas. Modules of equal size, shape and slit configuration are described herein for convenience of illustration and comprehension.

Figure 4:
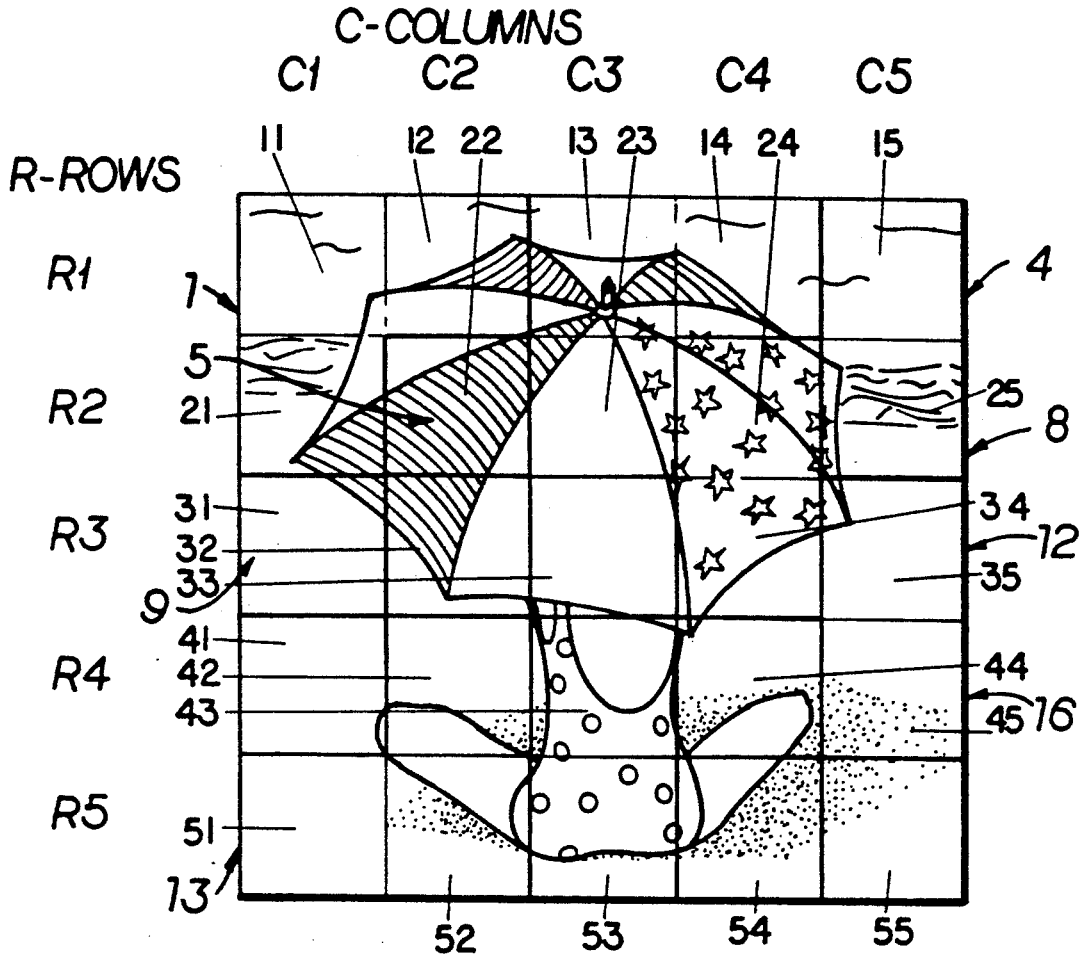
FIG. 4 is a plan view of an assembled composite puzzle showing a restored graphic pattern, referred to herein as the Beach Scene, on one surface thereof.
Figure 6:
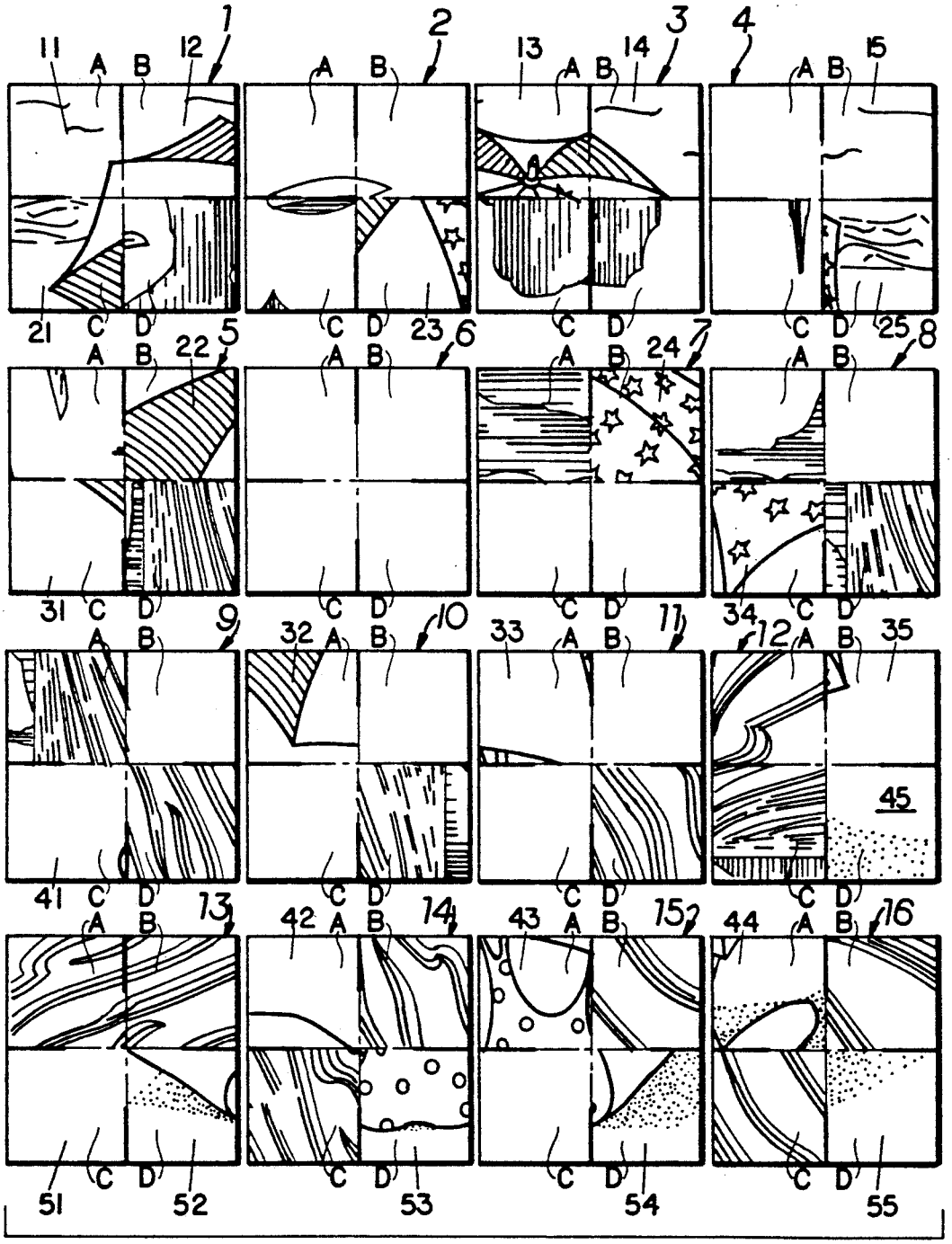
FIG. 6 is a plan view of sixteen indicia-bearing puzzle modules before assembly to restore the predetermined graphic pattern illustrated in FIG. 4.
Figure 12:
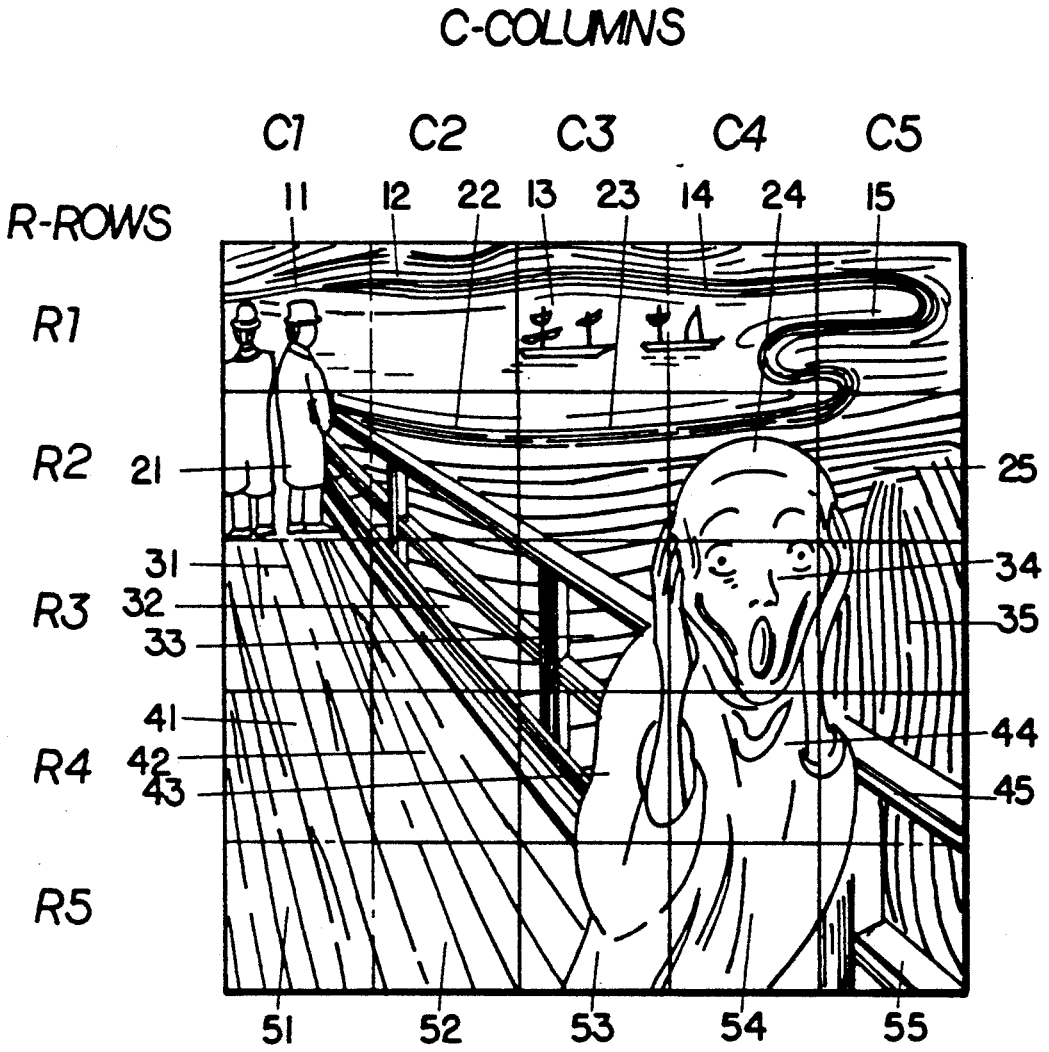
FIG. 12 is a plan view of an assembled composite puzzle showing a restored graphic pattern, referred to herein as The Scream, on one surface thereof.

FIGS. 5, 9 and 13 are schematic representations in matrix format that illustrate the rows and columns of visible or uncovered panels for the composite assemblies formed from sixteen modules and which display the restored graphic patterns illustrated in FIGS. 4, 6 and 12 respectively. The numerals 11–15, 21–25, 31–35, 41–45 and 51–55 of FIG. 5, for example, represent uncovered module quadrants bearing segments of the predetermined graphic pattern referred to as the Beach Scene (FIG. 4). When these segments are combined upon assembly of the composite the Beach Scene is restored. These matrices are schematic illustrations of the way the interlinked puzzles modules will look when the predetermined graphic pattern is fully restored.

Figure 7:
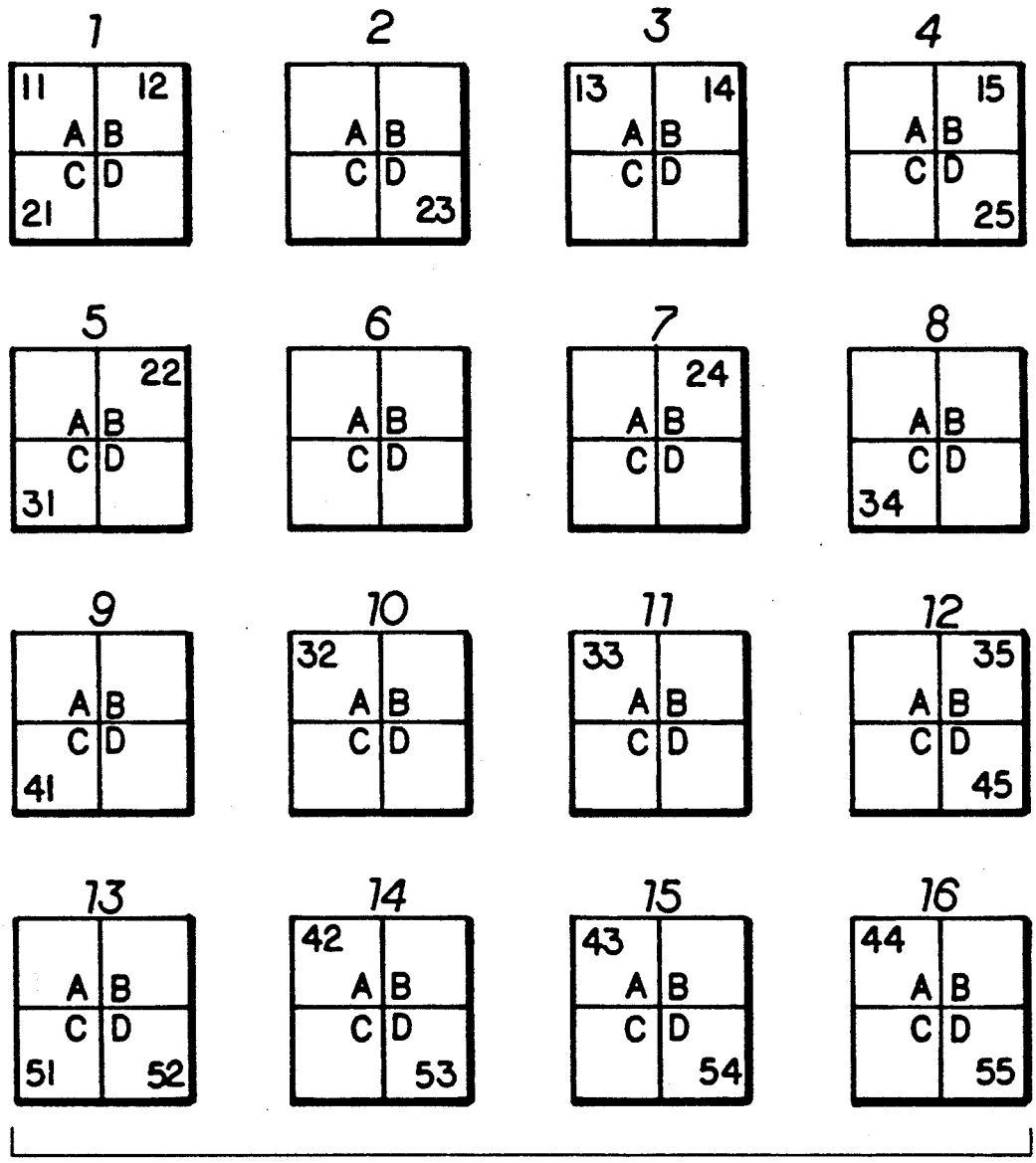
FIG. 7 is a schematic view in a matrix format of sixteen puzzle modules in which those several module quadrants which are to remain exposed to restore the pattern of FIG. 4 are identified.
Figure 8:
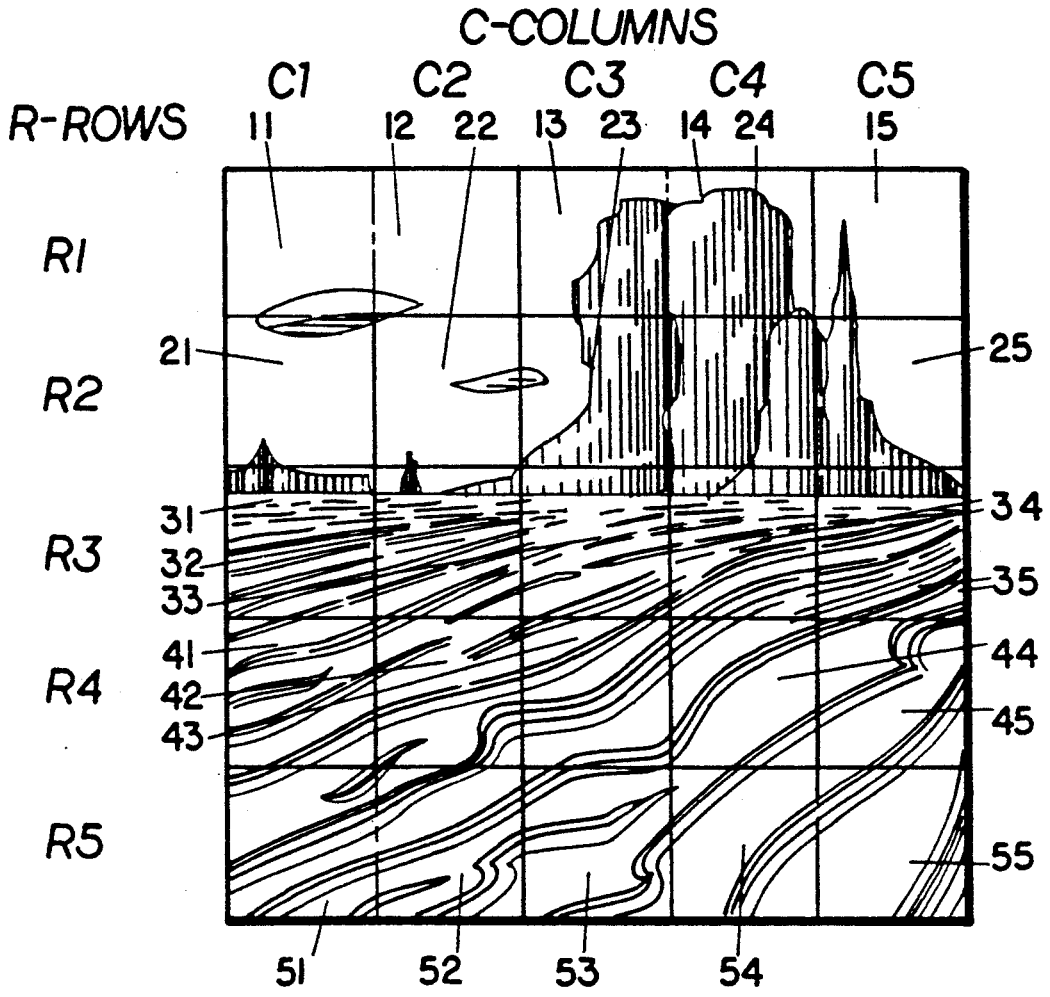
FIG. 8 is a plan view of an assembled composite puzzle showing a restored graphic pattern, referred to herein as the Desert Scene, on one surface thereof.
Figure 10:
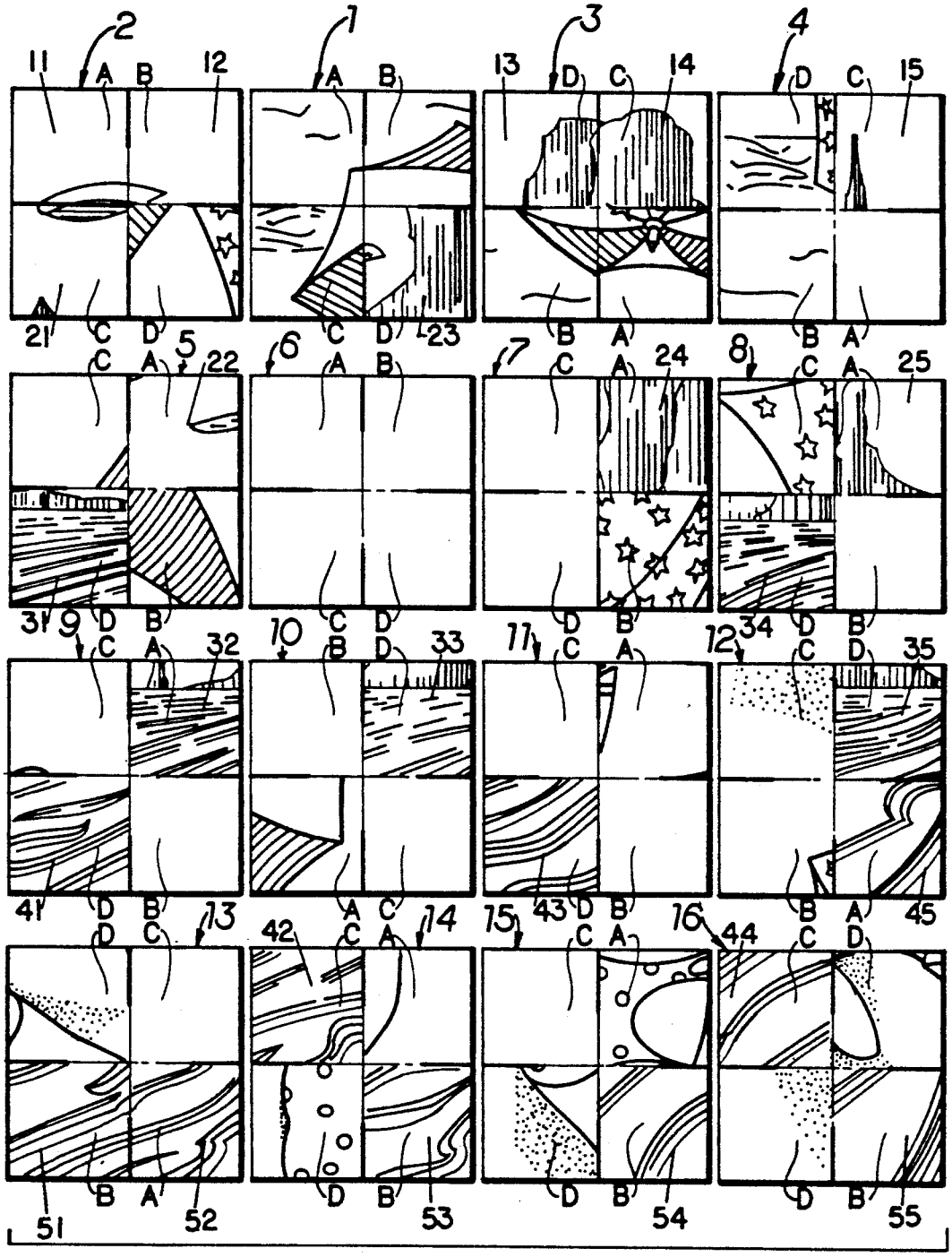
FIG. 10 is a plan view of sixteen indicia-bearing puzzle modules before assembly to restore the predetermined graphic pattern illustrated in FIG. 8.
Figure 11:
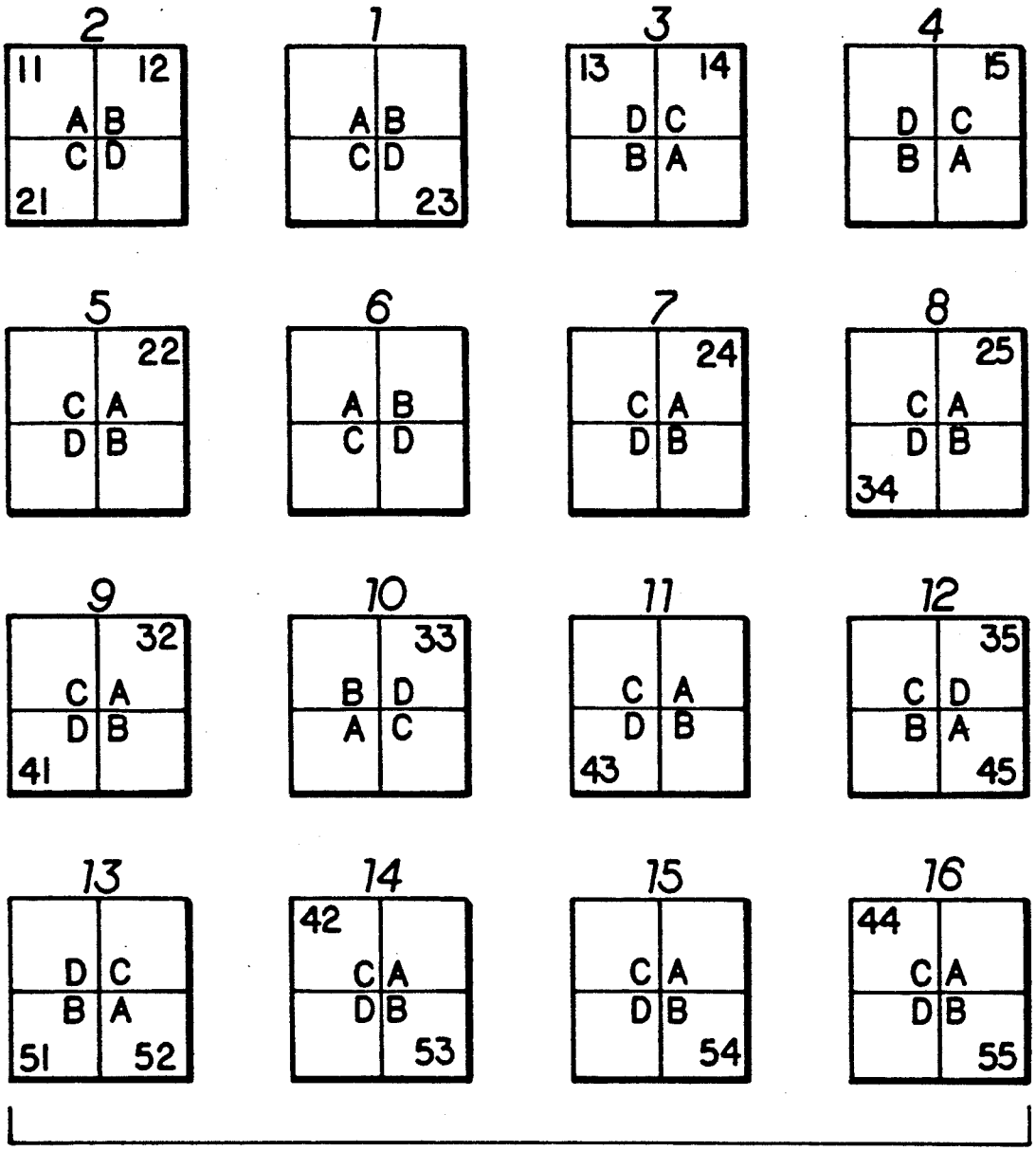
FIG. 11 is a schematic view in a matrix format of sixteen puzzle modules in which those several module quadrants which are to remain exposed to restore the pattern of FIG. 8 are identified.
Figure 14:
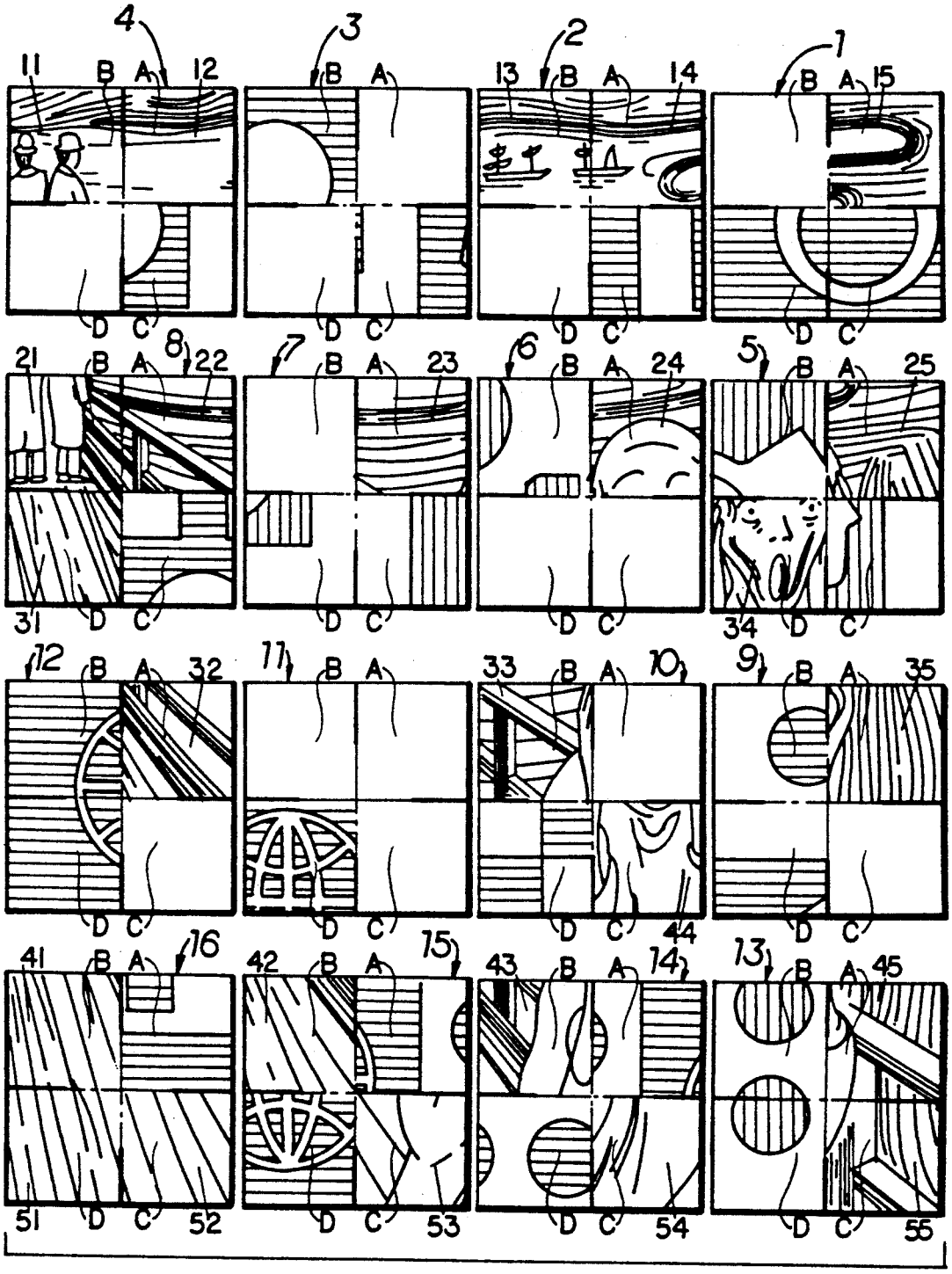
FIG. 14 is a plan view of sixteen indicia-bearing puzzle modules before assembly to restore the predetermined graphic pattern illustrated in FIG. 12.
Figure 15:
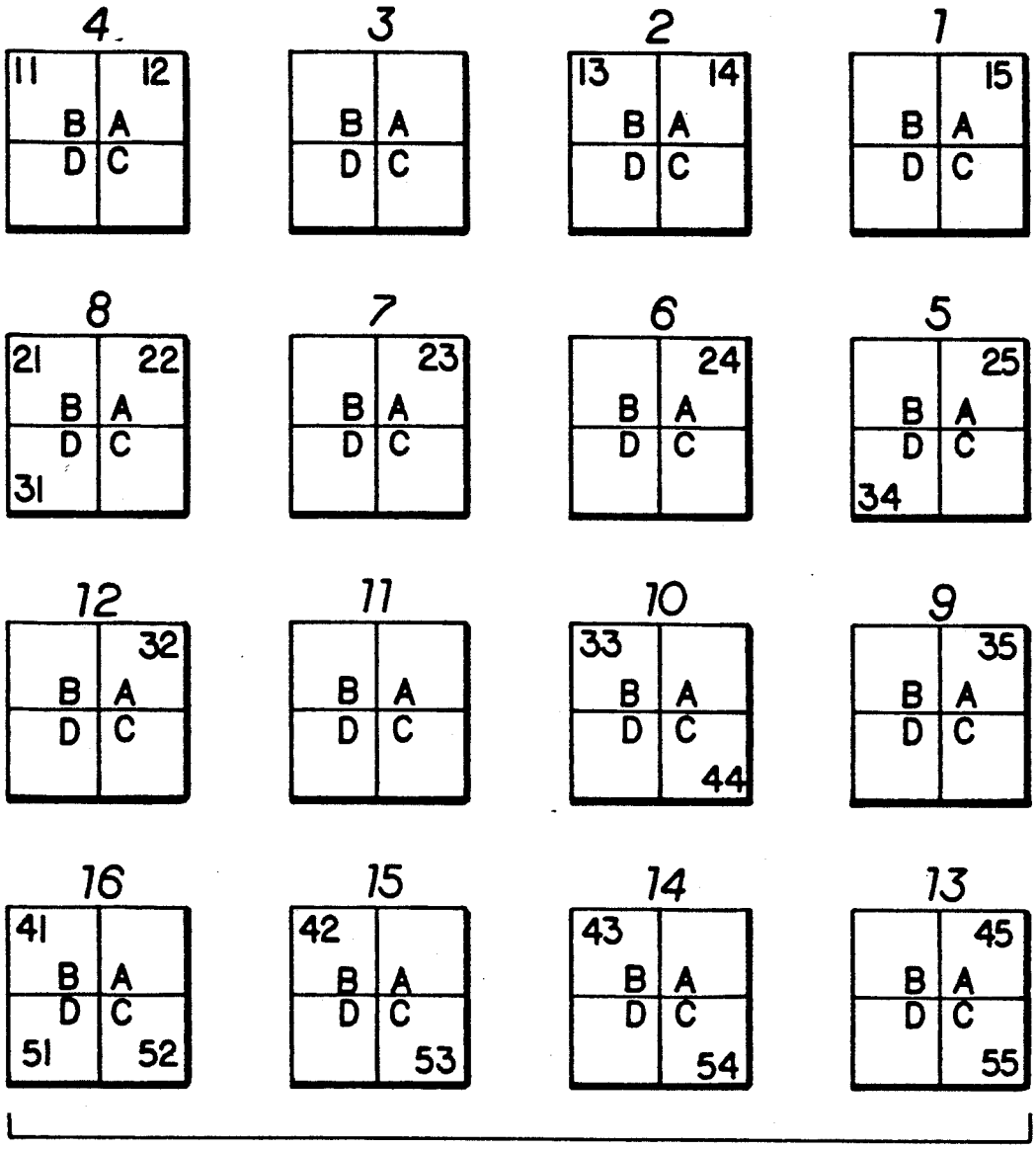
FIG. 15 is a schematic view in a matrix format of sixteen puzzle modules in which those several module quadrants which are exposed upon restoration of the pattern of FIG. 12 are identified in relation to other module quadrants.

The same numbers that designate rows and columns in FIGS. 5, 9 and 13 are used in the matrices and solution keys of the graphic patterns illustrated in FIGS. 6–7, 10–11, and 14–15. In particular, the solution keys of FIG. 7, 11 and 15 schematically show each of the sixteen modules utilized for the graphic patterns of FIGS. 5, 9 and 13. Each module of the group shown in FIG. 7 for example is numbered from 1–16 and has four quadrants A–D. Each indicia-bearing quadrant for the predetermined graphic pattern is identified by one of the numerals 11–15, 21–25, 31–35, 41–45 or 51–55. For example, quadrants A, B and C of module "1" in FIG. 7 bear picture segments 11, 12 and 21 respectively. In contrast, only quadrant D of module "2" is provided with a segment 23 of the graphic pattern, while module "6" does not bear any indicia at all. As set forth above, the idea of the game or puzzle is to restore the complete picture, The Beach Scene for example, by interlocking the modules via the slits 100 so as to align and expose those quadrants displaying the picture segments corresponding to the numbers 11–15 and so on. The actual picture segments of The Beach Scene represented by the various numbers are illustrated on puzzle modules in disassembled form in FIG. 6.

Figure 17:
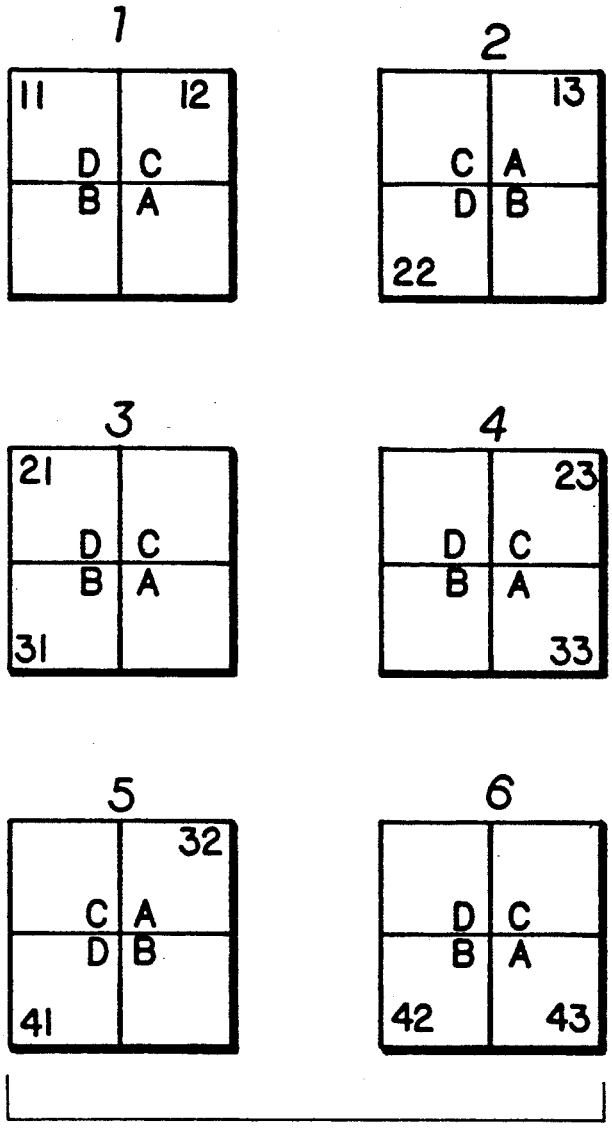
FIG. 17 is a schematic view in matrix format of six puzzle modules in which those several module quadrants which are exposed after restoration of the pattern of FIG. 16 are identified in relation to other module quadrants.

FIGS. 16 and 17 illustrate a relatively simple puzzle. There the composite assembly is constructed from the six modules 1–6 schematically shown in FIG. 17. In this instance each of the modules 1–6 is of the type shown in FIG. 1. Various ones of the quadrants A–D of each module are provided with numerals 11, 12, 13, 21, 22, 23, 31, 32, 33, 41, 42 and 43, each such numeral representing a portion of a graphic pattern shown schematically in its entirety in FIG. 16. To complete the puzzle, the modules 1–6 are progressively interleaved along the slits 100 with various quadrants of one module overlapping or being overlapped by corresponding quadrants of other modules. When the solution to the puzzle is achieved, only the quadrants bearing or represented by the numerals 11–13, 21–23, 31–33 and 41–43 will be visible on the front surface of the completed assembly.

A more complex problem is presented by the graphic representation, The Beach Scene, shown in FIG. 4. Here, a total of sixteen puzzle modules is used to complete the scene. These sixteen modules are schematically represented in FIG. 7. There, as indicated above, the various quadrants are provided with picture segments represented by the numerals 11–15, 21–25, 31–35, 41–45 and 51–55 and the complete picture is schematically represented in FIG. 5. Just as in the embodiment of FIGS. 16 and 17, the various modules are progressively interleaved and various quadrants are exposed or covered so that the final result is as depicted in FIGS. 4 and 5. FIG. 6 represents a solution key showing how the actual picture segments may be correlated to the numerals of FIG. 5.

Figure 2:
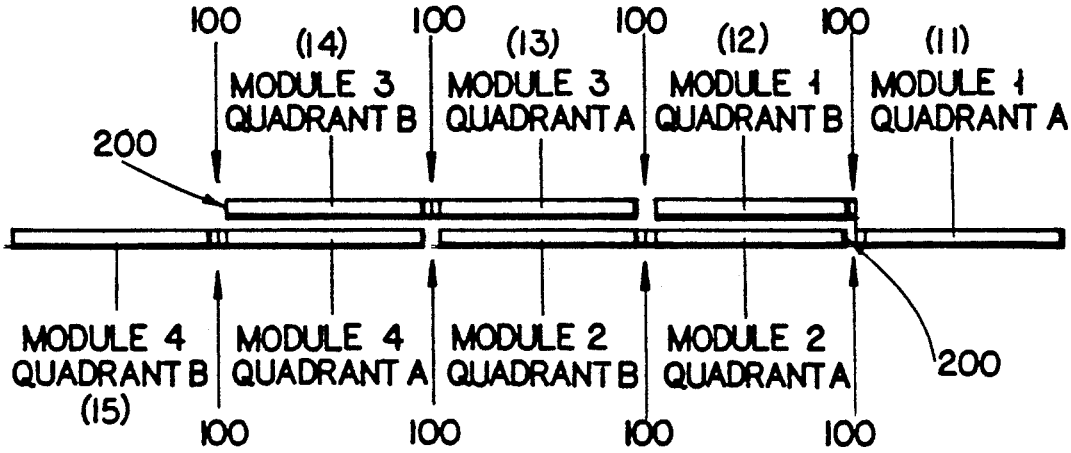
FIG. 2 is a side or edgewise view of the uppermost exterior row of sixteen interleaved puzzle modules of the type shown in FIG. 1 when assembled to display the complete graphic pattern shown in FIG. 4.

FIG. 2 illustrates a side or edgewise view of the uppermost row of module quadrants of a composite assembly restoring the graphic pattern the Beach Scene of FIG. 4. The restored picture would be visible from the module surfaces facing upwardly in FIG. 4. The numbers in parentheses refer to the picture segments identified by those numbers in FIGS. 4 and 5. It will be seen that the top row of the composite puzzle consists of quadrants of four modules, Nos. 1–4, which are overlapped, overlapping or standing alone. The slits 100 again are exaggerated for ease of illustration.

The interlinked assembly shown in FIG. 2 of the indicia-bearing modules depicted in FIG. 6 is created by taking, for example, module 2 and interlinking module 3 with it via slits 100. With reference to FIG. 6, the horizontal slit 100 between quadrants B and D of module 2 will engage with the horizontal slit 100 between quadrants A and C of module 3. The orientation of the engaged modules is such that indicia-bearing quadrant A (13) of module 3 overlaps non-indicia-bearing quadrant B of module 2 and indicia-bearing quadrant D (23) of module 2 overlaps non relevant quadrant B of module 3. In the same way, indicia-bearing quadrant B (12) of module 1 may be engaged so as to overlap non indicia-bearing quadrant A of module 2 and indicia-bearing quadrant B (14) of module 3 may be engaged so as to overlap non indicia-bearing quadrant A of module 4.

FIG. 2 is representative not only of the uppermost row (i.e. R1 of FIG. 5) of interleaved module quadrants (11–14) for the restored graphic pattern of FIG. 4, but also of each of the remaining outermost columns or rows (C1, C5 and R5 of FIG. 5) of the assembled composite puzzle. Thus while the four corners R1C1, R1C5, R5C1 and R5C5 of FIG. 5 of the assembled composite will be only one module deep, for example quadrant A of module 1 and quadrant B of module 4 remain uncovered as two of the four corners of the composite assembly, the remaining picture segments of each such row or column as shown will be two modules deep. In addition the module orientation depicted in the composite assembly of FIG. 2, restoring The Beach Scene on one surface, will also exist for the solution to the more complex puzzle which would obtain where the graphic pattern for The Scream were formed on the back surface of the interlinked composite while the Beach Scene was formed on the front surface.

Figure 3:
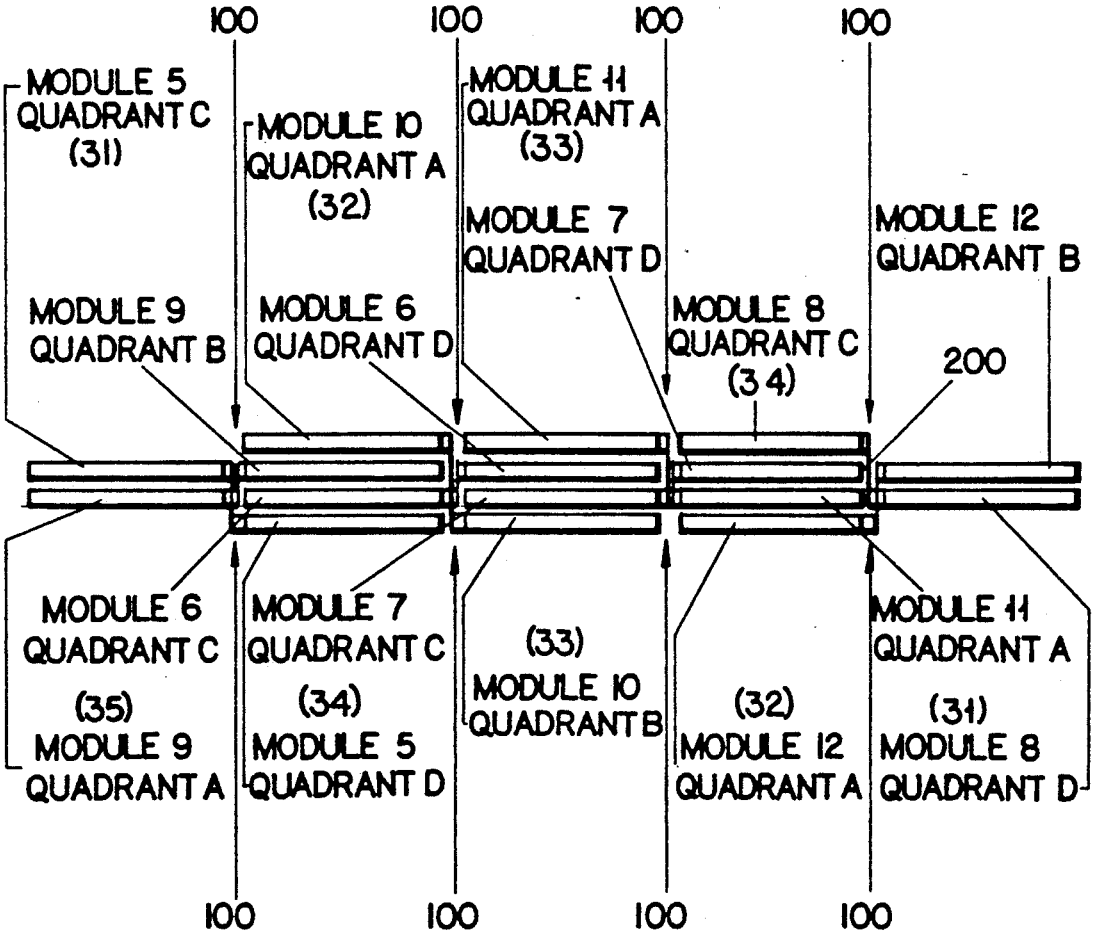
FIG. 3 is a side or edgewise view of an interior row of a composite assembly of sixteen puzzle modules used to display simultaneously the graphic pattern of FIG. 4 on one side and the graphic pattern shown in FIG. 12 on the other side.

Like FIG. 2, FIG. 3 is an edgewise or side view of the composite assembly representing the solution to the puzzle requiring restoration of the graphic pattern the Beach Scene, taken along an interior row (for example R2–R4 of FIG. 5) of the composite assembly. The numbers in parentheses above the five top quadrants as shown in FIG. 3 are representative of the uncovered quadrants or panels of R3 in FIG. 4 and correspond to the numbered picture segments as depicted in FIG. 4. Since FIG. 3 depicts a portion of a composite assembly representative of the solution to the puzzle requiring restoration of an image on both the front and back surfaces of the composite, the numbers in parentheses below the five lower quadrants as shown in FIG. 3 represent, by way of example, the corresponding image segments shown in R3 of the composite image shown in FIG. 12.

In this embodiment, the interior panels R2C2–R2C4, R3C2–R3C4 and R4C2–R4C4 (FIGS. 4 and 5) of the completed composite shown in FIG. 4 are four modules deep while the three middle panels of each exterior row and column are two modules deep. It is clear that to the extent that overlapping of the module quadrants is required as shown in FIG. 3 in order to restore one or more graphic patterns or pictures, the present invention provides significant complexities and challenge to the user.

FIGS. 12–15 represent a composite puzzle solution for restoring the graphic pattern The Scream. This picture is shown in a puzzle utilizing the sixteen modules of FIGS. 14 and 15. As in FIGS. 5–7, the numerals shown in the various quadrants of the modules of FIG. 15 represent those portions of the picture The Scream shown in FIGS. 12 and 14. As described above, the picture The Scream will appear when the modules of FIGS. 14 and 15 are interlinked so as to expose the quadrants carrying picture portions 11–15, 21–25, 31–35, 41–45 and 51–55 as shown in FIG. 13. Exactly the same analysis applies to FIGS. 8–11, which represent yet another possible graphic pattern referred to as the Desert Scene. In each case the modules of the assembled composite by which one or more of the pictures illustrated herein are displayed will have the overlapping configurations as depicted by way of example in FIGS. 2 and 3.

As indicated above, a still more complex puzzle may be obtained when it is required to solve the puzzle by creating one of the foregoing pictures on the front surface of the composite an simultaneously creating another of the foregoing pictures on the back surface of the composite assembly. Thus each of the quadrants on opposite sides of each module is provided with a portion of a different graphic representation, such as one of the foregoing pictures. The modules are interleaved one at a time until the puzzle is solved and the complete restored pictures ar displayed on both sides of the composite assembly.

The invention claimed in this application extends the two-dimensional game or puzzle disclosed and claimed in said parent application and described above to a third dimension.

Figure 18A:
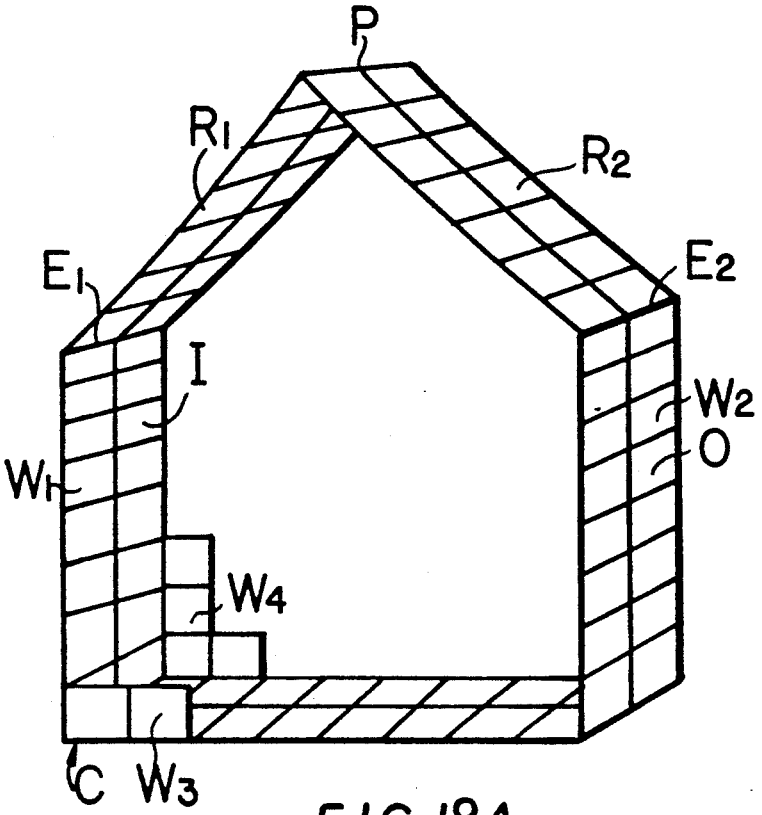
FIG. 18A is a fragmentary perspective view of a three-dimensional house-like structure constructed in accordance with the invention.

FIG. 18A shows a house-like structure that can be assembled in accordance with the present invention. It is formed with an outside O and an inside I that constitute respectively first and second surfaces of the assembly or composite.

Figure 18B:
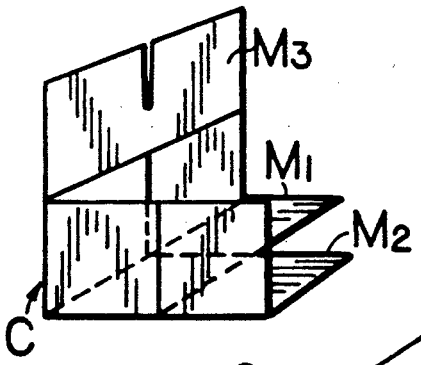
FIG. 18B is a perspective view of a corner of the house-like structure of FIG. 18A.
Figure 18C:
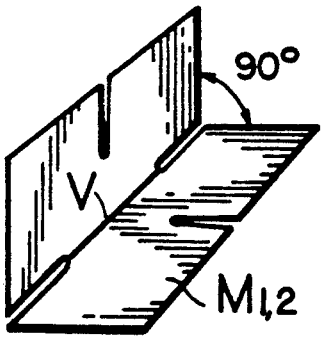
FIG. 18C is a perspective view of a module forming a dihedral angle of 90° about its centerline.
Figure 18D:
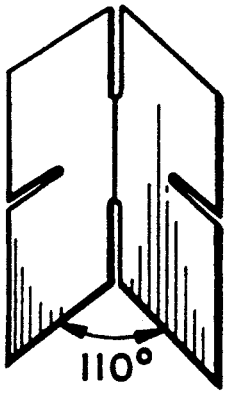
FIG. 18D is a perspective view of a module forming a dihedral angle of 110° about its centerline.
Figure 18E:
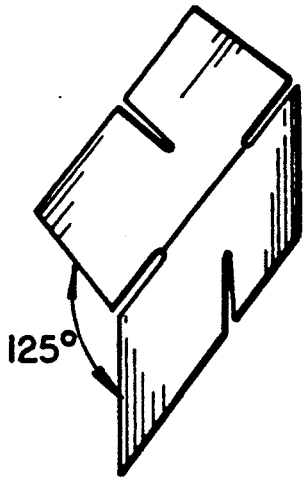
FIG. 18E is a perspective view of a module forming a dihedral angle of 125° about its centerline.
Figure 18F:
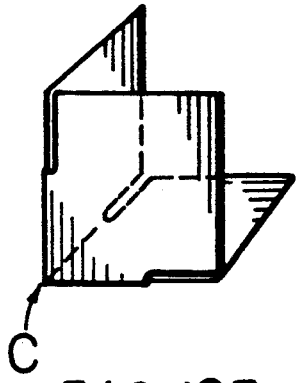
FIG. 18F is a perspective view of a module forming a corner defined by the intersection of three planes.

FIG. 18F shows a corner module C, which appears in the lower-left-front corner of the structure of FIG. 18A and is shown also in FIG. 18B. A similar corner module can of course be employed in order to complete the other three lower corners of the structure of FIG. 18A.

Two modules as shown in FIG. 18C are employed in the structure of FIG. 18B as modules $M_1$ and $M_2$, the lines constituting the vertices of the respective dihedral angles formed by the modules being oriented orthogonally to each other and each module overlapping the other and the corner module C. The module of FIG. 18C forms a dihedral angle of 90° about its centerline. In other words, the line forming the vertex V bisects the game piece or module.

Figure 18G:
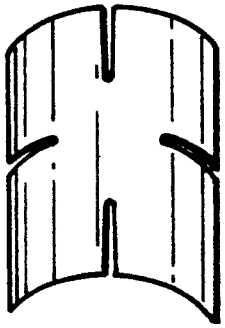
FIG. 18G is a perspective view of a module that is cylindrically curved.
Figure 18H:
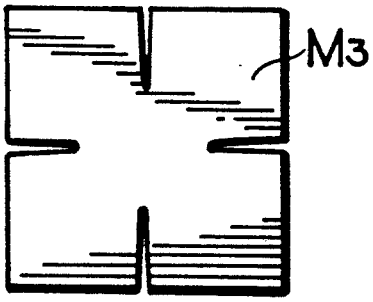
FIG. 18H is a plan view of a module that can be used to form any of the modules shown in FIG. 18C, 18D, 18E and 18G and that is similar to the module of FIG. 1 except for the shape of the slits formed therein.

The flat module of FIG. 18H is shown in FIG. 18B as module $M_3$ overlapping the module $M_1$ and the corner module C. The various flat surfaces of the structure of FIG. 18A are formed primarily of the module $M_3$ of FIG. 18H.

At the eaves $E_1$ and $E_2$ where the walls $W_1$ and $W_2$ meet the roof R, modules according to FIG. 18E are employed. The module of FIG. 18E forms a dihedral angle of 125° about its centerline, but of course other angles can be used. At the peak P of the roof R, modules as shown in FIG. 18D can be employed. The module of FIG. 18D forms a dihedral angle of 110° about its centerline, but of course other angles can be used.

Figure 18J:
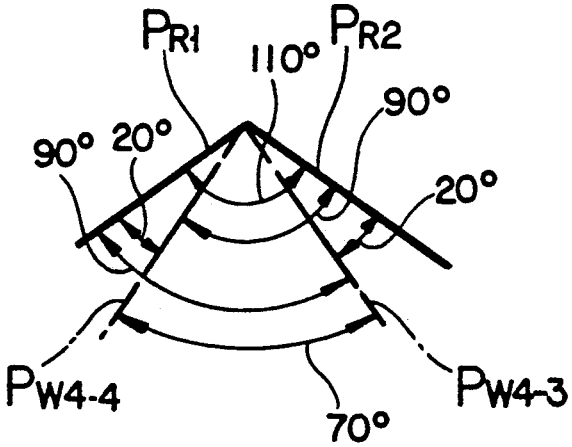
FIGS. 18I and 18J are diagrams used to explain the overlapping of certain modules employed in the structure of FIG. 18A.
Figure 18I:
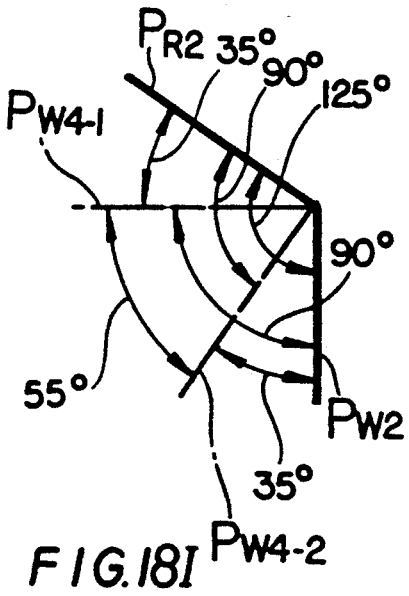

The modules shown are sufficient to complete the assembly of the house-like structure of FIG. 18A, including the front and back walls $W_3$ and $W_4$. In particular, at the eaves $E_1$ and $E_2$, in order to form front and back walls shown partially as $W_3$ and $W_4$, respectively, it is not necessary to employ modules other than the ones described above. A module forming a right dihedral angle as shown in FIG. 18C can be oriented so that the line forming the vertex of the dihedral angle extends in the vertical direction and can have one panel $P_{W2}$ (FIG. 18I) interleaved in the wall $W_2$ and the other panel $P_{W4-1}$ extending into the wall $W_4$; and another module such as the one shown in FIG. 18C can be oriented so that the line forming the vertex of the dihedral angle extends from the eave $E_2$ along the edge of the roof at an angle of 35° up and to the left with respect to the horizontal and can have one panel $P_{R2}$ interleaved in the roof section $R_2$ and the other panel $P_{W4-2}$ extending into the rear wall $W_4$. These panels in the rear wall $W_4$ will overlap as shown in FIG. 18I in such a way that the edges of the panels $P_{W4-1}$ and $P_{W4-2}$ in the wall $W_4$ that meet at the eave $E_2$ will form an angle of 55° with respect to one another.

That is, the eave angle of 125° less the right angle measured from the roof section $R_2$ to the panel edge $P_{W4-2}$ leaves an angle of 35° between that edge and the wall $W_4$; and the eave angle of 125° less the right angle measured from the wall $W_4$ to the panel edge $P_{W4-1}$ leaves an angle of 35° between the latter edge and the roof section $R_2$. Subtracting 35°+35° from 125° leaves an angle of 55° between the two panel edges, as illustrated in FIG. 18I.

At the peak P, a module forming a right dihedral angle as shown in FIG. 18C can be oriented so that the line forming the vertex of the dihedral angle extends from the peak P down and to the left at an angle of 35° with respect to the horizontal and can have one panel $P_{R1}$ interleaved in the roof section $R_1$ and the other panel $P_{W4-3}$ extending into the rear wall $W_4$; and another module such as the one shown in FIG. 18C can be oriented so that the line forming the vertex of the dihedral angle extends from the peak P down and to the right at an angle of 35° with respect to the horizontal and can have one panel $P_{R2}$ interleaved with the roof section $R_2$ and the other panel $P_{W4-4}$ extending into the rear wall $W_4$. These panels in the rear wall $W_4$ will overlap as shown in FIG. 18J in such a way that the edges of the panels $P_{W4-3}$ and $P_{W4-4}$ that meet at the peak P will form an angle of 70° with respect to one another.

That is, the peak angle of 110° less the right angle measured from the roof section $R_1$ to the panel edge $P_{W4-3}$ leaves an angle of 20° between that edge and the roof section $R_2$; and the peak angle of 110° less the right angle measured from the roof section $R_2$ to the panel edge $P_{W4-4}$ leaves an angle of 20° between the latter edge and the roof section $R_1$. Subtracting 20°+20° from 110° leaves an angle of 70° between the two panel edges, as illustrated in FIG. 18J.

A similar analysis relating to the other intersections of the eaves $E_1$ and $E_2$ and peak P with the front and rear walls $W_3$ and $W_4$ shows that the illustrated modules are sufficient to complete the structure of FIG. 18A. Of course, openings forming doors and windows, etc. (not illustrated), can be left in the house-like structure of FIG. 18A to give a more realistic effect.

Depending on its degree of curvature (or arc), the module of FIG. 18G can be employed to form either the peak P or the eves $E_1$ and $E_2$ of the house-like structure of FIG. 18A. The curvature is preferably but not necessarily cylindrical.

From the illustrations and foregoing description it will be seen that the invention provides a novel game or puzzle in three dimensions that comprises a plurality of game or puzzle modules adapted to be interlinked via slits in accordance with the method of the present invention to form one or more composite assemblies displaying one or more restored graphic patterns whether predetermined or created as part of a game on one surface or both first and second surfaces of the composite.

The terms and expressions which have been used are used as terms of description and not of limitation; there is no intention in the use of such words and expressions of excluding any equivalents of the features shown or described, or portions thereof, and it is recognized that various modifications are possible within the scope of the invention claimed. Moreover, the invention has been described in the context of several embodiments which are not to be considered as limiting. Other embodiments whether as a game or a puzzle utilizing the present invention may be perceived by those of ordinary skill in the relevant art without departing from the scope of the invention which is to be measured solely by the following claims

I claim:

1. An assembled puzzle comprising a plurality of pieces each having a plurality of edges and each piece bearing indicia thereon and being formed with at least one slit in each of said edges, the slits in each piece collectively delineating a plurality of areas of said piece, and the pieces being assembled by engaging a slit of one piece with a slit of another piece in such a manner that selected ones of said areas are either hidden or exposed in order to form at least one composite image.

2. A puzzle according to claim 1 wherein each of the pieces forms a parallelogram.

3. A puzzle according to claim 1 wherein each of the pieces forms a rectangle.

4. A puzzle according to claim 1 wherein each of the pieces forms a square.

5. A puzzle according to claim 1 comprising at least six of the pieces.

6. A puzzle according to claim 1 comprising at least forty-two of the pieces.

7. A puzzle according to claim 1 wherein each of the indicia is of one solid color.

8. A puzzle according to claim 1 wherein the assembly has two sides and two composite images are formed on one of said two sides.

9. A puzzle according to claim 1 wherein the assembly has opposite sides two composite images are formed respectively on said opposite sides.

10. A puzzle according to claim 1 wherein at least one of said pieces forms a dihedral angle.

11. A puzzle according to claim 1 wherein said dihedral angle has a vertex that bisects said at least one of said pieces.

12. A puzzle according to claim 1 wherein at least one of said pieces forms a corner defined by the intersection of three planar surfaces.

13. A puzzle according to claim 1 wherein at least one of said pieces is curved.

14. A puzzle according to claim 1 wherein at least one of said pieces is cylindrically curved.

15. A puzzle according to claim 1 wherein said assembly is three dimensional and has an outside and an inside.

* * * * *